US006906666B2

(12) United States Patent
Karlsson et al.

(10) Patent No.: US 6,906,666 B2
(45) Date of Patent: Jun. 14, 2005

(54) BEAM ADJUSTING DEVICE

(75) Inventors: Dan Karlsson, Solna (SE); Björn Lindmark, Stockholm (SE); Stefan Jonsson, Stocksund (SE); Tord Liljevik, Bromma (SE)

(73) Assignee: Allgon AB, Taby (SE)

( * ) Notice: Subject to any disclaimer, the term of this patent is extended or adjusted under 35 U.S.C. 154(b) by 0 days.

(21) Appl. No.: 10/399,861

(22) PCT Filed: Sep. 12, 2001

(86) PCT No.: PCT/SE01/01951

§ 371 (c)(1),
(2), (4) Date: Sep. 25, 2003

(87) PCT Pub. No.: WO02/35651

PCT Pub. Date: May 2, 2002

(65) Prior Publication Data

US 2004/0041740 A1 Mar. 4, 2004

(30) Foreign Application Priority Data

Oct. 27, 2000 (SE) ..... 0003929

(51) Int. Cl.[7] ..... H01Q 3/22
(52) U.S. Cl. ..... 342/375; 342/81

(58) Field of Search ..... 342/81, 154, 157, 342/368, 375

(56) References Cited

U.S. PATENT DOCUMENTS 5,949,303 A * 9/1999 Arvidsson et al. ..... 333/136
6,621,465 B2 * 9/2003 Teillet et al. ..... 343/797

FOREIGN PATENT DOCUMENTS

| | | |
|---|---|---|
| EP | 0618639 A2 | 10/1994 |
| EP | 0984509 A2 | 3/2000 |
| WO | WO96/37922 | 11/1996 |

* cited by examiner

*Primary Examiner*—Dao Phan
(74) *Attorney, Agent, or Firm*—Jacobson Holman PLLC

(57) ABSTRACT

A device for adjusting the beam direction of a beam radiated from a stationary array of antenna elements. The device includes a feed line structure configured as a star with at least four line segments extending from a central source connection terminal at the centre of the star, to the respective feed connection terminals. The dielectric body with two different body portions, having different effective dielectric values, is displaceable between two end positions in a central, region of the device.

12 Claims, 3 Drawing Sheets

BEAM ADJUSTING DEVICE

FIELD OF THE INVENTION

The present invention relates to a device for adjusting the beam direction at an antenna.

RELATED ART AND BACKGROUND OF THE INVENTION

Such a device is previously known from the document WO 96/37922 (Allgon AB). The known device comprises a feed line structure integrated with a stationary array of antenna elements so as to enable adjustment of the direction of the beam radiated from the array. The feed line structure includes a feed conductor line pattern disposed on a fixed carrier plate at a distance from and in parallel to a fixed ground plate, and a movable dielectric plate located therebetween. The feed line pattern is elongated in the same direction as the movement direction of the dielectric plate. The propagation velocity of the signal components is reduced by the presence of the dielectric plate between the respective feed line and the ground plate. Accordingly, by displacing the dielectric plate in the longitudinal direction, the phase difference between the various signal components may be controlled.

In the previously known device, the feed line pattern is configured basically in meander-like loops with several loop portions extending back and forth in the longitudinal direction. Accordingly, the signal paths are relatively long, and the losses of microwave power being transferred in the device is relatively high. Moreover, because of the various meander-like loops extending in parallel to each other, the device is necessarily relatively wide in a transverse direction. Therefore, the overall dimensions of the device are relatively large.

SUMMARY OF THE INVENTION

Against this background, a main object of the present invention is to provide such a device having a feed line structure which inherently involves low losses and which is smaller and less expensive to manufacture than the previously known device.

Accordingly, the feed line structure is generally configured as a star with at least four line segments extending from a source connection terminal, at the centre of the star, to the respective feed connection terminals. At least two line segments extend generally in a first direction along the main direction of the device, and two further line segments extend generally in an opposite direction. The dielectric body is divided into different portions having different effective dielectric values. A first body portion is located adjacent to a first pair of line segments extending in opposite directions, and a second body portion is located adjacent to a second pair of line segments likewise extending in opposite directions. In this way, even if the line segments have substantially the same length, it is possible to obtain a phase angle difference. Preferably, the feed line structure is configured as the letter "H" with four line segments of substantial equal length.

The difference in "effective dielectric value" may be obtained in different ways. The two body portions may be made of different materials having two different dielectric constants. Alternatively, or in addition thereto, the two body portions may have different geometrical cross-sections along at least a major part of their respective lengths, e.g. a difference in thickness. Preferably, as a further alternative, the two body portions may have mutually different geometrical irregularities making the effective dielectric values different. Such irregularities may comprise holes, e.g. extending in a transverse direction from the respective line segments to the ground plane.

Advantageously, the feed line structure may comprise strip line segments located between top and bottom walls of a closed elongated housing, the top and bottom walls serving as a ground plane. Then, each body portion may comprise upper and lower parts located above and below the strip line segments, respectively.

These and other features of the invention will become apparent from the detailed description below.

The invention will be explained more fully below with reference to the appended drawings illustrating some preferred embodiments.

DETAILED DESCRIPTION OF PREFERRED EMBODIMENTS

Figure 1:
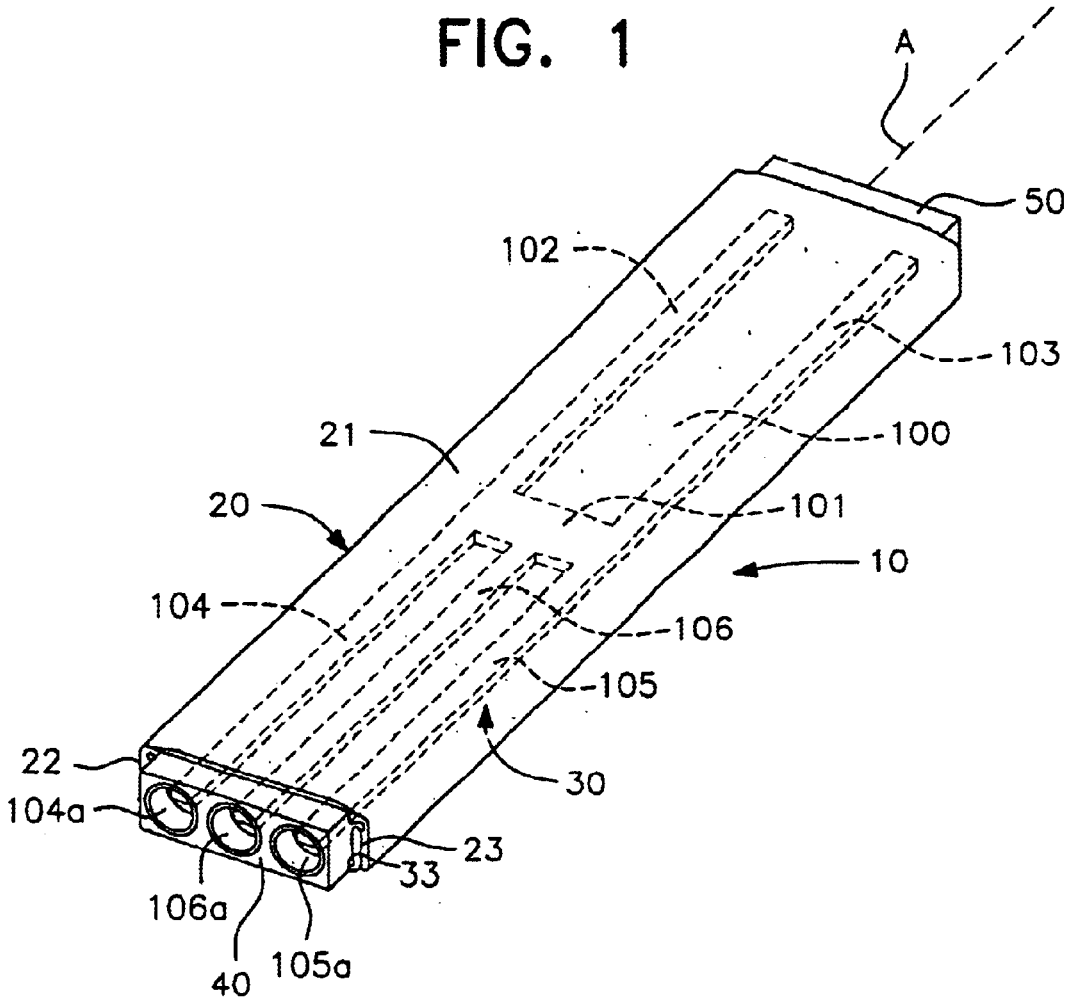
FIG. 1 shows the device according to the invention in a perspective view.
Figure 2:
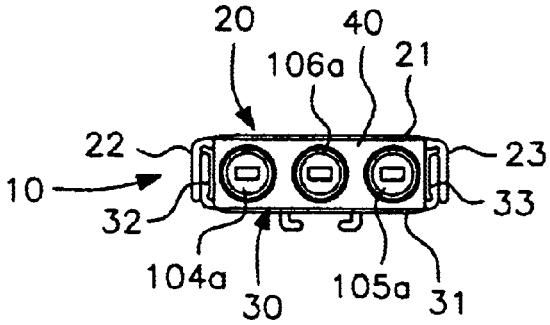
FIG. 2 shows the device of FIG. 1 in an end view.

The device shown in FIGS. 1 and 2 comprises an elongated box-like housing 10 consisting of an upper part 20, a lower part 30, end pieces 40, 50 and a feed line structure, generally denoted 100, inside the housing 10.

The housing 10 is of the general kind described in the separate Swedish patent application entitled "Shielded Housing" filed simultaneously by the same applicant. The disclosure of the "Shielded Housing" application is included herein by reference.

The upper part 20 of the housing includes a substantially planar top wall 21 and, integral therewith, two downwardly directed, longitudinally extending outer side flanges 22, 23. The lower part 30 of the housing includes a substantially planar bottom wall 31 and, integral with the longitudinal edge portions of the bottom wall 31, inner side flanges 32 and 33. These inner side flanges 32, 33 are dimensioned to make contact, substantially over the entire external surface thereof, with the inside surfaces of the outer side flanges 22, 23. As explained in the separate "Shielded Housing" application, such a surface contact is obtained irrespective of the exact dimensions of the upper and lower parts within certain limits maintained during manufacture of the device. The top and bottom walls 21 and 31 of the housing are held at a pre-determined, well-defined mutual distance defined by the respective end piece 40, 50 as explained in detail in the "Shielded Housing" application.

The housing 10 accommodates a feed line structure 100 and a movable dielectric body 111 serving as a device for adjusting the beam direction radiated from a stationary array of antenna elements (not shown), coupled to the device.

In the illustrated embodiment, the feed line structure 100 is configured like the letter "H" with a central source connection terminal 101, first and second straight line segments 102, 103 extending in a first direction along the main direction A of the device and third and fourth straight line segments 104, 105 extending in a second direction being opposite to the first direction. Each feed line segment is connected to an associated feed connection terminal 102*a*, 103*a*, 104*a* and 105*a* respectively. See also FIG. 4.

The source connection terminal 101 is connectable to a signal source by means of a feed conductor 106, which extends centrally between the two line segments 104, 105 and is connected to a feed terminal 106*a*.

In use, the feed terminal 106*a* is connected, e.g. via a coaxial cable, to transceiver circuits (not shown), e.g. included in a base station of a cellular mobile telephone system. The feed connection terminals 102*a*, 103*a*, 104*a*, 105*a*, on the other hand, are connected, e.g. via four coaxial cables, to associated antenna elements or sub-arrays, e.g. pairs of antenna elements, arranged in a stationary array, normally a linear row, in an antenna, e.g. a base station antenna. Preferably, the transmission lines between the respective feed connection terminals and the associated antenna elements have such lengths that the phase shift, from the source connection terminal to the respective antenna element or sub-array, is generally different for each one of the four antenna elements or sub-arrays. Moreover, these differences can be adjusted by means of the feed line structure 100 with a displaceable dielectric body inside the housing 10, as will be explained below.

Figure 3:
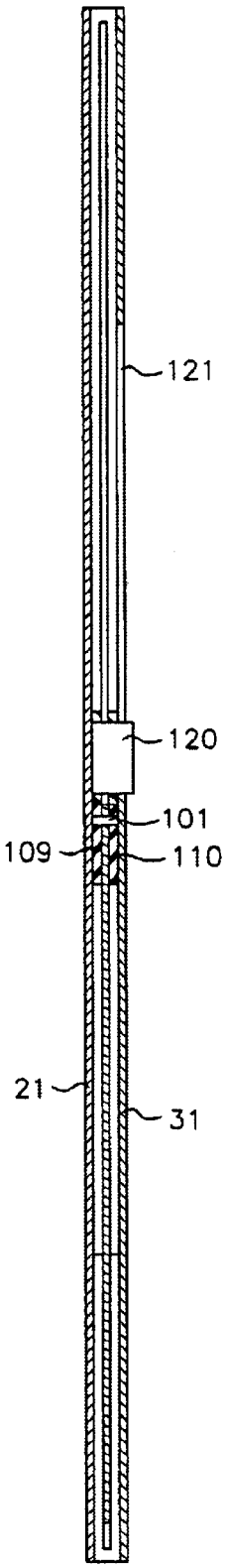
FIG. 3 shows a longitudinal central section through the device of FIG. 1.
Figure 4:
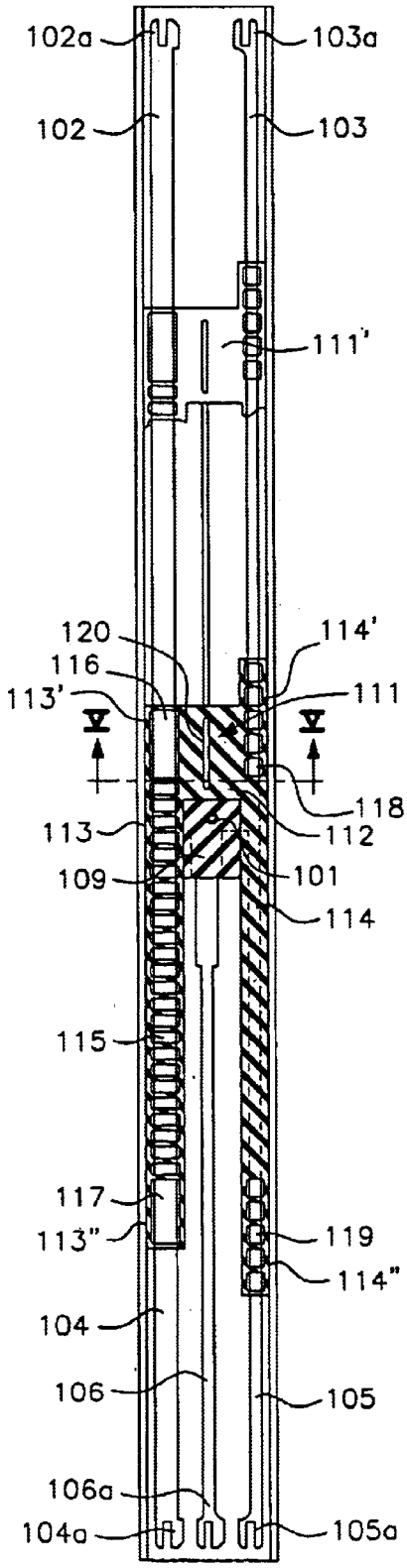
FIG. 4 shows a planar view of the device of FIG. 1 with a top wall of the housing being taken away.

Turning now to FIGS. 3 and 4, a microwave signal appearing at the feed terminal 106*a* will propagate along the central feed conductor 106 to the centrally located source connection terminal 101. In order to gradually match the impedance to the impedance value at the junction point, the feed conductor 106 is widened stepwise towards the source connection terminal. Furthermore, adjacent to the terminal 101, there are upper and lower stationary dielectric elements 109, 110, serving to additionally match the impedance of the four feed line segments 102, 103, 104, 105 extending electrically in parallel from the source connection terminal 101 to the four feed connection terminals 102*a*, 103*a*, 104*a*, 105*a*. Thanks to the dielectric elements 109, 110, the impedance matching can be achieved without making the feed conductor 106 extremely wide adjacent to the source connection terminal 101. Therefore, the width of the housing 10 can be relatively small so as to reduce the overall dimensions of the device. These dimensions will be reduced for other reasons as well, as will be explained further below.

The feed conductor 106 and the feed line segments 102, 103, 104, 105 are embodied as strip lines between the top and bottom walls 21 and 31, the latter walls serving as ground planes. See also FIGS. 5 and 6.

As compared to microstrip embodiments, the strip line structure has a number of advantages. First, the device can be made shorter and less wide. The reduced width is obtained because the strip lines are generally narrower than corresponding microstrip lines (with the same impedance and ground plane distance), and the parallel line segments can be positioned closer to each other without mutual coupling, since the double ground plane configuration limits the coupling between neighbouring parallel conductors more effectively. Also, dielectric material can be disposed above and below each strip, so virtually all of the electrical field is influenced by the dielectric material. Therefore, for a given phase angle difference, the length in the longitudinal direction can be reduced.

Secondly, there will be no problems with spurious radiation, since the total structure is confined within a shielded box or housing 10. Thirdly, the dielectric material above and below the strip can serve as spacing elements so as to keep the strip line in position.

In accordance with the present invention, a unitary body 111 of dielectric material is arranged between the housing walls 21,31 and the feed line segments 102, 103, 104, 105 so as to influence the propagation velocity and the phase shift of the signal components being transferred along the respective line segments. The dielectric body 111 is linearly displaceable along the longitudinal direction A of the device between two end positions, one of which is the fully drawn position in FIG. 4 and the other being the one indicated by dashed lines 111' somewhat to the right.

Figure 5:
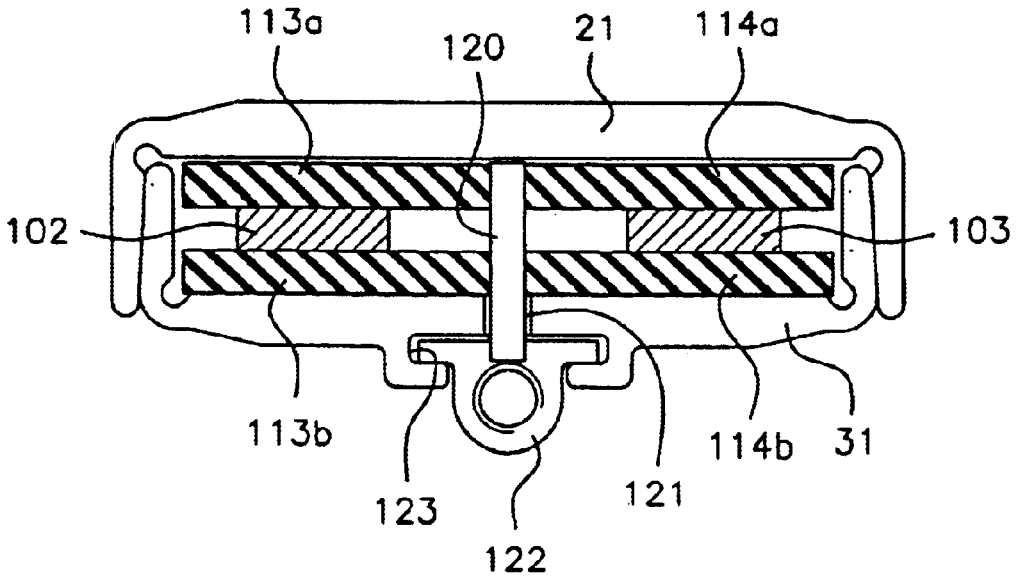
FIG. 5 shows a cross section through the device of FIG. 1.

The dielectric body 111 includes two longitudinal side portions connected by a transverse body portion 112, namely a first body portion 113 located along the first and third line segments 102, 104 and a second body portion 114 located along the second and fourth line segments 103 and 105. The overall length of the dielectric body 111 is somewhat greater than the distance between the end positions indicated in FIG. 4. Also, the dimensions are such that each body portion 113, 114 is always located in a longitudinal region close to the source connection terminal 101, so that its end portions 113', 113" and 114', 114", respectively, are situated adjacent to the oppositely extending line segments 102, 104 and 103, 105, respectively. According to the invention, the two body portions 113, 114 have different effective dielectric values. In the illustrated embodiment, this is achieved in that the major part of the second body portion 114 is solid, whereas the first body portion 113 is provided with a row of through-going holes 115, so that the retarding effect of the dielectric material is greater in the second body portion 114 than in the first body portion 113. In the illustrated embodiment, each body portion 113, 114 has an upper part 113*a*, 114*a*, and a lower part 113*b*, 114*b* respectively (FIG. 5). These upper and lower parts also serve as spacing elements between the feed line segments and the upper and lower housing walls 21, 31.

The longitudinal end portions 113', 113", 114', 114" of the two dielectric body portions 113, 114 are provided with recesses 116, 117 and holes 118, 119, respectively, so as to provide an impedance transformation between the central parts containing dielectric material and the air-filled spaces on both longitudinal sides of the dielectric body 111.

In a manner similar to that explained in the above-mentioned document WO 96/37922 (Allgon), the phase angle differences between the signal components at the feed connection terminals 102*a*, 103*a*, 104*a*, 105*a* will depend on the particular position of the dielectric body 111. When the dielectric body 111 is displaced a certain distance, all the phase shifts of the four signal components will be changed uniformly. Accordingly, the phase angle difference between the terminals associated with adjacent antenna elements (or sub-arrays) will always be mutually the same. Thus, the phase angle differences between the terminals 103*a* and 102*a*, between the terminals 102*a* and 104*a*, and between the terminals 104*a* and 105*a* will be equal to each other. Therefore, the composite beam from the four antenna elements coupled to these terminals will always have a wave front substantially in the form of a straight line, and the inclination of this wave front can be adjusted by displacing the dielectric body 111 to a different position in the longitudinal direction of the device.

In order to enable a controlled displacement of the dielectric body 111, a movement transfer member 120 is secured to the dielectric body 111 and extends through a longitudinal slot 121 in the bottom wall 31 of the housing 10. The member 120 is connected to a slide member 122, which is longitudinally guided in profiled grooves 123 formed at the lower side of the bottom wall 31. Of course, the slide member 122 can be mechanically activated as desired to adjust the inclinational angle of the beam from the antenna.

Figure 6:
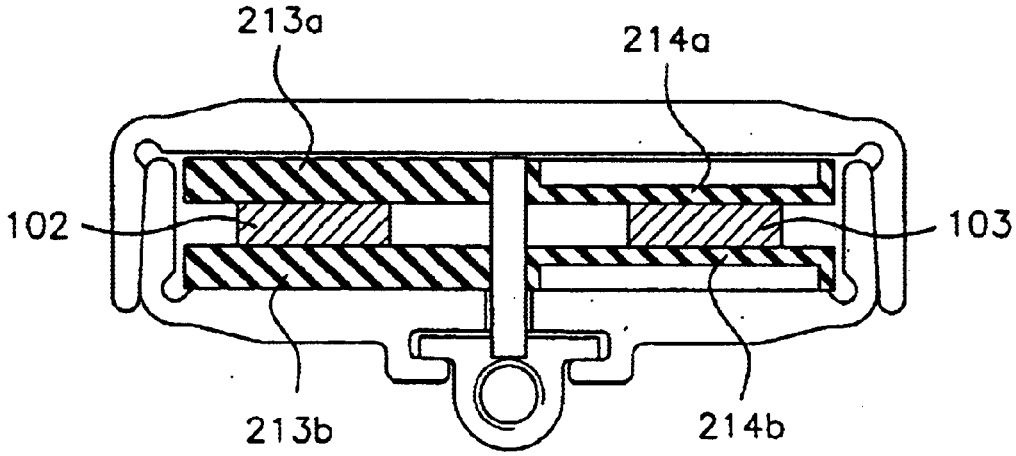
FIG. 6 shows a cross section through a modified version of the device of FIG. 1.

It will be appreciated that there are various ways to achieve a difference in effective dielectric value of the two body portions 113 and 114. An alternative to holes is to make the thickness of the two portions 113, 114 different, as illustrated in FIG. 6, where the second body portion 214*a*, 214*b* is much thinner than the first body portion 213*a*, 213*b*.

The illustrated embodiment with holes 115 in one of the body portions is advantageous for the reason that the two body portions 113, 114 have the same overall thickness and serve as effective spacing elements between the feed line segments and the housing walls.

Of course, other kinds of irregularities may be used instead of holes, such as recesses extending only partially through the material in a transverse direction. Longitudinal slots or the like are also possible.

Preferably, the dielectric material has a high dielectric constant. A suitable material is IXEF 1032 (manufactured by SOLVAY, Belgium) which has a dielectric constant of 4.5. Preferably, the dielectric constant of the dielectric material should be in the integral between 2 and 6.

Generally, low dielectric constant values make the whole structure longer, as the difference in electrical length is less between an air line and a line with dielectric material beneath and above. A too high dielectric constant value, on the other hand, makes the impedance difference so great that multiple transformation sections 113',113", etc might be necessary to achieve a good impedance match, with associated increased length. A higher dielectric constant value also makes the design more sensitive to thickness tolerance induced air gaps between the strip line and the dielectric material.

The central source connection terminal may itself serve as a feed connection terminal for direct connection to an antenna element. Moreover, there may be more than four feed line segments extending in a star configuration from the central source connection terminal, e.g. three feed line segments in each opposite direction with associated dielectric body portions having mutually different effective dielectric values.

Figure 7:
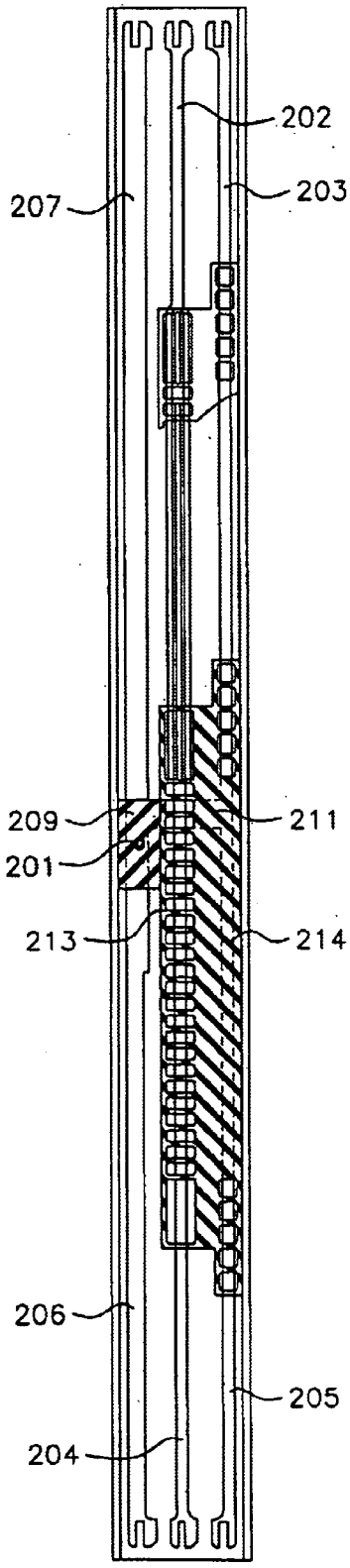
FIG. 7 shows a second embodiment of the device, including a different feed line structure.

A modified embodiment of the feed line structure is shown in FIG. 7, where corresponding parts are denoted with numerals 201, etc instead of 101, etc. (FIGS. 3 and 4). The displaceable dielectric body 211, with side portions 213,214, covers (partially) only the four line segments 202, 203, 204, 205, whereas the feed conductor 206 and a fifth line segment 207 extend freely inside the housing with air gaps to the top and bottom walls 21,31 (FIG. 2).

The fifth line segment 207 is connected to a centrally located antenna element. The phase angle of the signal component reaching this centrally located antenna element (not shown) or sub-array is independent of the particular position of the displaceable dielectric body 211. The line segments 202,203 are connected, e.g. via coaxial cables, to two antenna elements or sub-arrays on one side of the central element, and the line segments 204,205 are connected to two antenna elements or sub-arrays on the other side of the central element.

What is claimed is:

1. A device for adjusting the beam direction of a beam radiated from a stationary array of antenna elements, said device comprising at least four antenna element feed points coupled to a common signal source via a planar feed line structure having a source connection terminal to be connected to said source and at least four feed connection terminals to be connected to said antenna element feed points, said feed line structure being elongated in a main direction at a distance from and in parallel to a fixed ground plane on at least one side of said feed line structure, a movable dielectric body located between said feed line structure and said ground plane so as to change the exciting phase of signal components being transferred between said source connection terminal and the respective feed connection terminals, said dielectric body being movable in said main direction for effecting a controlled phase shift change of said signal components so as to adjust said beam direction, said feed line structure extending from said source connection terminal to said feed connection terminals, at least a first line segment and a second line segment extending generally in a first direction along said main direction, at least a third line segment and a fourth line segment extending generally in a second direction being opposite to said first direction, said dielectric body having a first body portion located adjacent to said first and third line segments and having a first effective dielectric value, and a second body portion located adjacent to said second and fourth line segments and having a second effective dielectric value being different from said first effective dielectric value, and said dielectric body being linearly displaceable between two end positions while keeping said first and second body portions in proximity to the respective pair of oppositely extending line segments.

2. The device as defined in claim 1, wherein said dielectric body is elongated and has a length exceeding the distance between said two end positions.

3. The device as defined in claim 1, wherein said feed line structure is configured as the letter "H" with four line segments of substantially equal length.

4. The device as defined in claim 1, wherein a feed conductor extends from a feed terminal at one end of the device along two of said four line segments to said source connection terminal.

5. The device as defined in claim 1, wherein said first and second body portions of said dielectric body have different geometrical cross-sections along at least a major part of their respective length.

6. The device as defined in claim 1, wherein said first and second body portions of said dielectric body have mutually different geometrical irregularities making the effective dielectric values different.

7. The device as defined in claim 6, wherein said irregularities comprise holes.

8. The device as defined in claim 7, wherein said holes extend in a transverse direction from said line segment to said ground plane.

9. The device as defined in claim 1, wherein said first and second body portions of said dielectric body are made of different materials having two different dielectric constants.

10. The device as defined in claim 1, wherein said planar feed line structure comprises strip line segments located between mutually parallel top and bottom walls of a closed elongated housing, said top and bottom walls serving as said ground plane.

11. The device as defined in claim 10, wherein each of said body portions of said dielectric body comprises an upper part and a lower part, said upper part being located between said strip line segment and said top wall and said lower part being located between said strip line segment and said bottom wall.

12. The device as defined in claim 10, wherein said dielectric body is movable by means of a movement transfer member secured on said dielectric body, said movement transfer member extending through a longitudinal slot in said elongated housing and being mechanically displaceable from the outside of said housing.

* * * * *